United States Patent [19]

Blassingame

[11] Patent Number: 4,741,679

[45] Date of Patent: May 3, 1988

[54] OIL WELL PUMP TRAVELING VALVE

[76] Inventor: Donald L. Blassingame, 7432 NW. 5 Ter., Oklahoma City, Okla. 73127

[21] Appl. No.: 920,822

[22] Filed: Oct. 20, 1986

[51] Int. Cl.[4] ..... F04B 21/04

[52] U.S. Cl. ..... 417/554

[58] Field of Search ..... 417/554, 553, 552, 511, 417/514; 137/533.11

[56] References Cited

U.S. PATENT DOCUMENTS 2,326,902 8/1943 Thomason ..... 417/552

2,386,593 10/1945 Carter ..... 417/444

3,139,039 6/1964 Adams ..... 417/554

*Primary Examiner*—Leonard E. Smith

*Assistant Examiner*—Leonard P. Walnoha

*Attorney, Agent, or Firm*—Robert K. Rhea

[57] ABSTRACT

A gas-lock eliminating traveling valve for a sucker rod operated oil pump includes a fluid outlet ported pump head connecting inner and outer sleeves with the upper end of a working barrel for reciprocating the latter. A valve is tethered within the inner sleeve in a manner insuring separation of the valve from its seat for opening the pump fluid passageway and exhausting gas from the pump bore with each complete sucker rod stroke.

4 Claims, 1 Drawing Sheet

OIL WELL PUMP TRAVELING VALVE

BACKGROUND OF THE INVENTION

1. Field of the Invention

This invention relates to an oil well pump traveling valve mechanism operated from the surface of the earth through its connection with a vertically reciprocating sucker rod string which prevents the development of a gas lock condition in the pump.

In pumping oil wells, virtually all of the oil includes a quantity of natural gas in solution. During a typical pumping operation, the fluid medium of the well undergoes substantial pressure changes, and these pressure changes tend to allow the gas in solution to become liberated from the liquid constituents of the fluid medium, and the liberated gas may interfere with pumping operations. For example, the fluid medium of a well prior to entering the tubing string or pumping chamber of the well is subjected to a pressure known as "bottom hole pressure." This bottom hole pressure relates to the inherent pressure of the production formation and to the hydrostatic head of the fluid medium within the well bore. In typical oil wells that require pumping, there is provided a pair of spaced ball seat valves with the pump piston being positioned above the lowermost ball seat valve.

Where the well pump includes a stationary valve ball and seat, a traveling valve ball and seat is movable relative to the stationary valve. The variable volume between the ball and seat of the stationary and traveling valves constitutes the pumping chamber. A condition of gas-lock will occur when an excessive amount of gas collects within the pumping chamber and the pressure developed by the hydrostatic head of liquid above the ball and seat of the traveling valve is equal to or greater than the pressure of the compressed gas within the pumping chamber in the compression stroke, and when the pressure within the pumping chamber during the vacuum stroke is equal to the bottom hole pressure of the well.

The presence of gas in the fluid also causes "valve chatter" which is destructive of seats and balls of ball check valves. Valve chatter caused by gas also decreases the efficiency of the pump due to improper closing of the ball valves with their seats. It is of course very desirable to provide a traveling oil pump valve mechanism that is capable of efficiently lifting well fluid, including oil, to the surface and which is also effective to prevent the development of a gaslock condition during pumping.

Accordingly, the present invention provides a novel traveling oil pump valve mechanism that serves as the traveling valve mechanism of a spaced valve pumping system and which automatically provides for venting liberated gas into the tubing string for production along with the liquid medium that is pumped from the well.

2. Description of the prior art

Prior patents attempting to eliminate gas-lock and fluid pound conditions in an oil well pump have generally disclosed telescoping sleeves having mating and mismating ports therein which generally provide an increase in the fluid flow from the pump against the static head of oil in the tubing.

The most pertinent prior patent is believed U.S. Pat. No. 1,614,000 which discloses a traveling valve and seat secured to the depending end of a sucker rod string and enclosed within a shell diametrically equal with the pump barrel and when coaxially aligned therewith in the bottom of an oil well permits the traveling valve and its seat assembly to enter and be reciprocated within the bore of the working barrel.

This invention is distinctive over the above named patent and other devices presently in use by interposing a pump head and outer sleeve between an oil well pump working barrel and the sucker rod string. An inner sleeve secured to the pump head contains a tethered ball valve and seat positively moved to open and closed position by sucker rod movement.

SUMMARY OF THE INVENTION

This invention provides a traveling valve assembly which includes a pump head connected with an outer sleeve threadedly connected axially with the top limit of a conventional oil well pump working barrel. The pump head is provided with outlet ports and supports an inner sleeve connected with the outer sleeve in a manner to permit limited reciprocating movement of the pump head and inner sleeve with respect to the outer sleeve which seats and unseats a tethered ball valve contained within the inner sleeve to insure opening and closing the oil pump fluid passageway.

The principal object of this invention is to provide a sucker rod operated traveling valve assembly for connection with the top end of an oil pump working barrel which includes a tethered ball valve seated and unseated in a positive action by respective up or down movement of the sucker rods which effectively eliminates gas-lock of the pump by positive opening and closing of the tethered ball valve with respect to its seat by the reciprocating action of the sucker rods.

Figure 1:
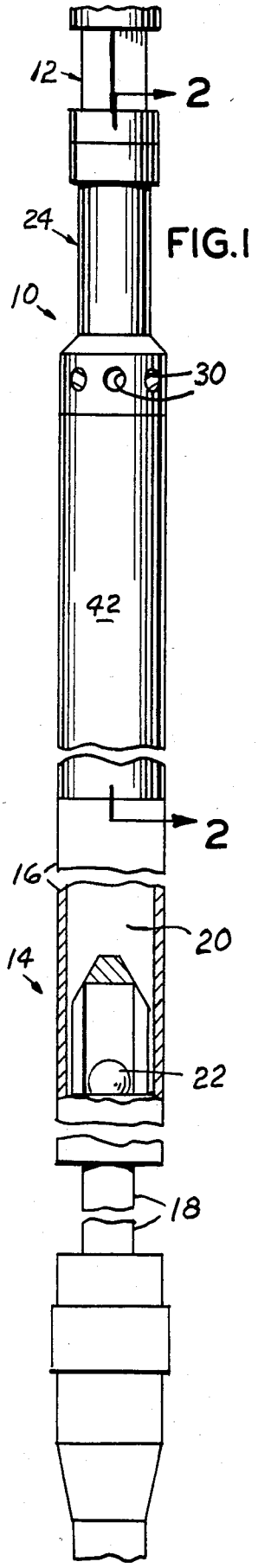
FIG. 1 is a fragmentary elevational view of the traveling valve interposed between the depending end of a sucker rod string and a conventional oil well pump working barrel.
Figure 2:
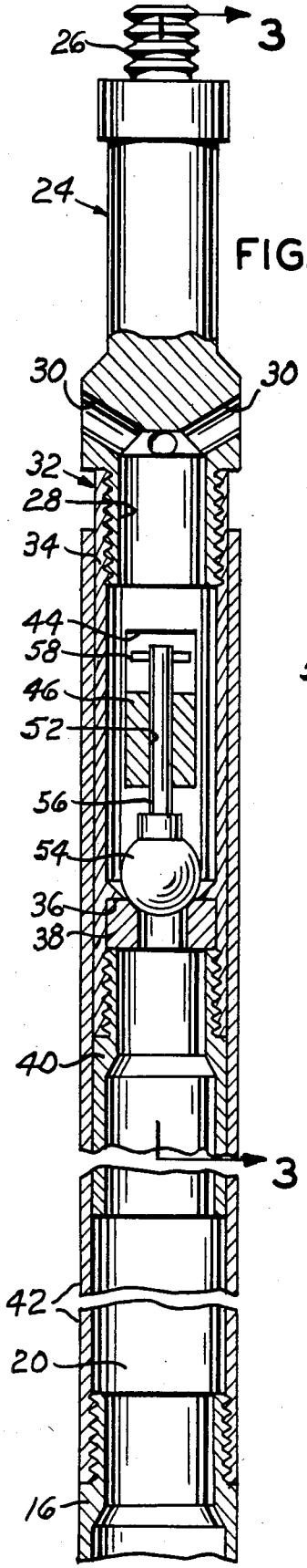
FIG. 2 is a vertical cross sectional view, to a larger scale, partially in elevation, taken substantially along the line 2—2 of FIG. 1 illustrating pump upstroke action.
Figure 3:
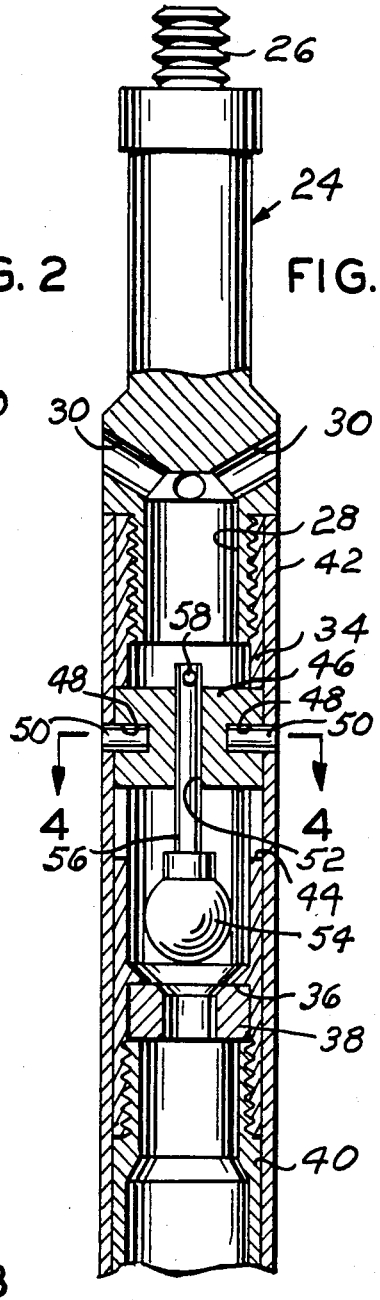
FIG. 3 is a fragmentary vertical cross sectional view taken substantially along the line 3—3 of FIG. 2 illustrating pump downstroke action; and, FIG. 4 is a horizontal cross sectional view taken substantially along the line 4—4 of FIG. 3. cl DESCRIPTION OF THE PREFERRED EMBODIMENTS Like characters of reference designate like parts in those figures of the drawings in which they occur.
Figure 4:
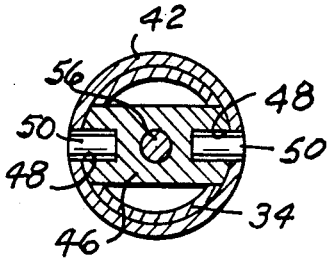

The reference numeral 10 indicates the traveling valve mechanism connected with the depending end of a sucker rod string 12 and connected, at its depending end, with a conventional oil well pump 14 in which the valve mechanism 10 replaces the top valve assembly and upper end portion of the conventional pump.

The pump 14 includes a working barrel 16 vertically reciprocated on a plunger 18 to form a pumping chamber 20 above a standing valve 22 in the manner well understood by those skilled in the art.

The device 10 comprises a pump head 24 substantially diametrically equal with the working barrel 16 and having a pin 26 at its upper end threadedly received by the depending end of the sucker rod string 12. The depending end of the head 24 is characterized by a tubular end portion formed by a central bore 28 terminating intermediate its ends and communicating with a plurality of fluid outlet ports 30 open to the periphery of the head 24. The depending end portion of the head is diametrically reduced and externally threaded for connection with a first or inner sleeve means 32 of selected length.

The inner wall of the sleeve 34 is provided, adjacent its depending end, with an annular downwardly facing shoulder 36 forming a stop for a valve seat 38. The depending end portion of the sleeve 34 is similarly internally threaded for receiving a tube 40 forming a continuation of the sleeve 34 and impinging the valve seat 38 against the shoulder 36. A second sleeve means 42 surrounds the sleeve 34 and tube 40 and is threadedly connected, at its depending end, with the working barrel 16. The sleeve 34 is further provided with a pair of diametrically opposed vertically elongated through the wall slots 44 of selected length and spaced a predetermined distance above the shoulder 36.

A crosshead 46, of predetermined dimensions, extends transversely through the sleeve 34 with its respective end portions abutting the inner wall surface of the second sleave 42 and nested by the respective sleeve slots 44 and is vertically moveable therein between the respective longitudinal end limits of the slots. The respective ends of the crosshead are provided with a pair of horizontally aligned sockets 48 which receive a pair of pins 50 projecting in opposing directions beyond the lateral limits of the crosshead and through cooperating bores formed in the wall of the outer sleeve 42 for the purposes presently explained.

The crosshead 46 is further centrally drilled vertically, as at 52, in substantial axial alignment with the sleeve means 32 and the annular seat 38.

A ball valve 54, interposed between the crosshead and the valve seat is secured to a valve stem 56 having a length greater than the vertical height of the crosshead. The stem is longitudinally slidable in the crosshead bore 52. The end portion of the valve stem opposite the ball is provided with a transverse pin 58 which tethers the ball valve 54 to the crosshead. The top end portion of the valve may be threaded for receiving a nut, not shown, in place of the pin 58, if desired.

Operation

In operation, as the sucker rod string 12 upstroke initially lifts the pump head 24 and inner sleeve 34 the valve seat 38 is moved within reach of the tethered ball 54 which seats and the hydrostatic pressure above the ball insures a positive seal.

Further upstroke movement of the traveling valve assembly lifts the outer sleeve means 42 by the crosshead being pin connected thereto, and the working barrel 16 which reduces the pressure in the pumping chamber 20 to fill with oil from the pump depending end fluid inlet by unseating and passing through the standing valve 22.

At the start of its downstroke, the sucker rod string, by moving the pump head and inner sleeve 34 downwardly, positions the valve seat 38 beyond the reach of the tethered ball 54 before the working barrel 16 is moved, thus insuring positive opening of the traveling valve on each stroke. This eliminates gas-lock and fluid pound.

Obviously the invention is susceptible to changes or alterations without defeating its practicability. Therefore, I do not wish to be confined to the preferred embodiment shown in the drawings and described herein.

I claim:

1. A traveling valve for a sucker rod operated oil well pump having a standing valve and a working barrel, comprising:

pump head means vertically reciprocated by the depending end of the sucker rod and having a depending tubular end portion provided with fluid outlet ports;

first sleeve means depending from said tubular end portion for forming a fluid passageway therewith, said first sleeve means comprising a first sleeve having diametrically opposed slots in the upper end portion of its wall;

second sleeve means surrounding the first sleeve means for connecting the pump head to said working barrel, crosshead means including a generally rectangular crosshead extending transversely through said first sleeve means and connecting said first sleeve means to the second sleeve means by its respective end surfaces confronting the inner wall surface of said second sleeve means through the respective first sleeve slot, the first sleeve slots being vertically elongated a distance greater than the vertical dimension of the crosshead respective end portions permitting vertical reciprocable movement of predetermined magnitude of the first sleeve means relative to the crosshead and the second sleeve means when the first sleeve is reciprocated;

an outstanding pin on each end of the crosshead and projecting through the wall of said second sleeve means; and, valve means tethered in said first sleeve means for opening and closing the fluid passageway in response to and in cooperative sequence with the reciprocating fluid pumping movement of said first sleeve means.

2. The traveling valve according to claim 1 in which said valve means includes:

a valve seat in said first sleeve;

a valve for sealing with said seat; and, means for tethering said valve to the crosshead for movement of the valve toward and away from the seat.

3. The traveling valve according to claim 2 in which the crosshead is transversely bored parallel with the axis of the first sleeve and in which the tethering means includes:

a valve stem on said valve freely projecting longitudinally through the crosshead bore; and, means on the valve stem preventing its separation from the crosshead.

4. The traveling valve according to claim 3 and further including:

other sleeve means including a tube depending from said first sleeve within said second sleeve means for supporting said valve seat and forming a continuation of said first sleeve.

* * * * *